United States Patent [19]

Hoffmann et al.

[11] Patent Number: 4,632,721

[45] Date of Patent: Dec. 30, 1986

[54] APPARATUS FOR APPLYING LABELS TO CONTAINERS

[75] Inventors: Wolfgang W. Hoffmann, Modesto; Svatoboj Otruba, Ceres, both of Calif.

[73] Assignee: Kris-Tech Corporation, Modesto, Calif.

[21] Appl. No.: 785,074

[22] Filed: Oct. 7, 1985

[51] Int. Cl.[4] ..... B65C 9/02; B65C 9/18

[52] U.S. Cl. ..... 156/458; 156/521; 156/568; 156/578; 156/DIG. 25; 156/DIG. 33

[58] Field of Search ..... 156/568, 521, 578, DIG. 25, 156/DIG. 26, DIG. 33, 443, 458

[56] References Cited

U.S. PATENT DOCUMENTS

| | | | |
|---|---|---|---|
| 3,864,187 | 2/1975 | Carter | 156/568 |
| 3,905,859 | 9/1975 | Patterson | 156/568 |
| 4,032,388 | 6/1977 | Dunning | 156/568 |
| 4,108,710 | 8/1978 | Hoffmann | 156/521 |
| 4,592,796 | 6/1986 | Schlacht | 156/568 |

*Primary Examiner*—Michael Wityshyn
*Attorney, Agent, or Firm*—Melvin R. Stidham

[57] ABSTRACT

The disclosure is of a labeling machine wherein a label transport drum carries one or more pairs of vacuum pads to grip the leading and trailing edges of a label. A knife carried directly on the drum acts with a stationary blade to sever each label from a continuous web. The vacuum pads are retracted as they pass the stationary blade, but when they carry a label past a glue roller, the vacuum pads are extended to press the label against the roller. If desired, two glue rollers may be employed, with different glues being applied to the leading and trailing edges of each label. In that case, one pad is retracted and the other extended at each glue roller.

8 Claims; 3 Drawing Figures

APPARATUS FOR APPLYING LABELS TO CONTAINERS

BACKGROUND OF THE INVENTION

This invention is an improvement over existing labeling apparatus, such as that shown in my prior U.S. Pat. No. 4,108,710 granted Aug. 22, 1978.

In such machines, a continuous strip of label material is gripped and pulled at its leading edge by a rotating label transport drum, and an individual label is severed therefrom by cutting means located ahead of the drum. Transverse ridges or projections on the label transport drum press the label against a glue applicator and then press the leading edge of the label against a container. The label is then released and wrapped around the container. The label transport drum is generally made of metal with an outer sleeve of an elastomer, perforated over its surface so that a vacuum can be pulled through the surface to grip the labels. When worn, the complete drum must be replaced, and this can be quite costly.

In many labeling operations, the label is wrapped completely around the container so that the trailing edge overlaps the leading edge. In such cases, it would be desirable to use one type of glue at the leading edge that is particularly adapted to adhere the label to the material of the container and another glue type at the trailing edge that would be better adapted to adhere the two overlapping portions of the label together. However, fixed radial projections on the vacuum drum, tend to press the label against both glue wheels, and it is not practical to use two separate glues unless the glue strip for the leading edge of the label is applied directly to the container before the label is applied.

It is further desirable that steps be taken to prevent contact between the glue wheel and the vacuum drum when there is no label present to accept the glue. In present machines, it is customary to pivot the glue applying apparatus away from the label transport drum in absence of a label. However, at the high speed operations common in container labeling machines, e.g. 750 containers per minute, the rapid movement of the relatively heavy gluing apparatus is difficult to accomplish and requires substantial bearing mountings.

OBJECTS OF THE INVENTION

It is an object of this invention to provide a labeling apparatus wherein a single transport drum can grip a strip of labeling material; sever a label from the strip; apply glue to its edges; and press the gummed leading edge against a container.

It is a further object of this invention to provide a labeling apparatus wherein the label transport drum may be conditioned to press the leading and trailing edges of a label, either against a single glue applicator or against separate glue applicators.

It is a further object of this invention to provide a container labeling apparatus wherein relatively small components of the label transport drum may be replaced when worn, to avoid replacement of the entire transport drum.

It is a further object of this invention to provide apparatus for adhering labels to containers wherein glue applicators may be quickly and easily inactivated in the absence of a label.

Further objects and advantages of this invention will become apparent from the description to follow, particularly when read in conjunction with the accompanying drawings.

SUMMARY OF THE INVENTION

In carrying out this invention, we provide means for feeding a continuous strip or web of container labeling material, means for delivering a supply of cans to a label applying station and a label transport drum for severing labels from the strip, applying glue to their leading and trailing edges and pressing the leading edge against the side of a container. The knife for severing the labels into lengths is carried directly on the label transport drum and the leading and trailing edges of the label are gripped by vacuum pads which are movable radially on the drum. In operation, the leading edge of the strip is gripped by one vacuum pad and then, a trailing portion is gripped by a second vacuum pad. When the knife, which is immediately behind the second vacuum pad, passes a complementary stationary blade, the blades sever the label, both vacuum pads being retracted as they pass the stationary blade. As each pad approaches a gum roller, it may be extended to press the label against the roller and apply a strip of glue. Where two different adhesives are to be applied to the leading and trailing edges, each pad is extended to press against one roller and retracted as it passes the other. In either event, after glue is applied, the first pad is extended to press the leading edge of the label against a container, e.g. a can or a bottle. At about the same time, the vacuum is cut off and air pressure may be applied to release the label from the pad. Then both pads are retracted as they again approach the stationary blade.

DESCRIPTION OF A PREFERRED EMBODIMENT

Figure 1:
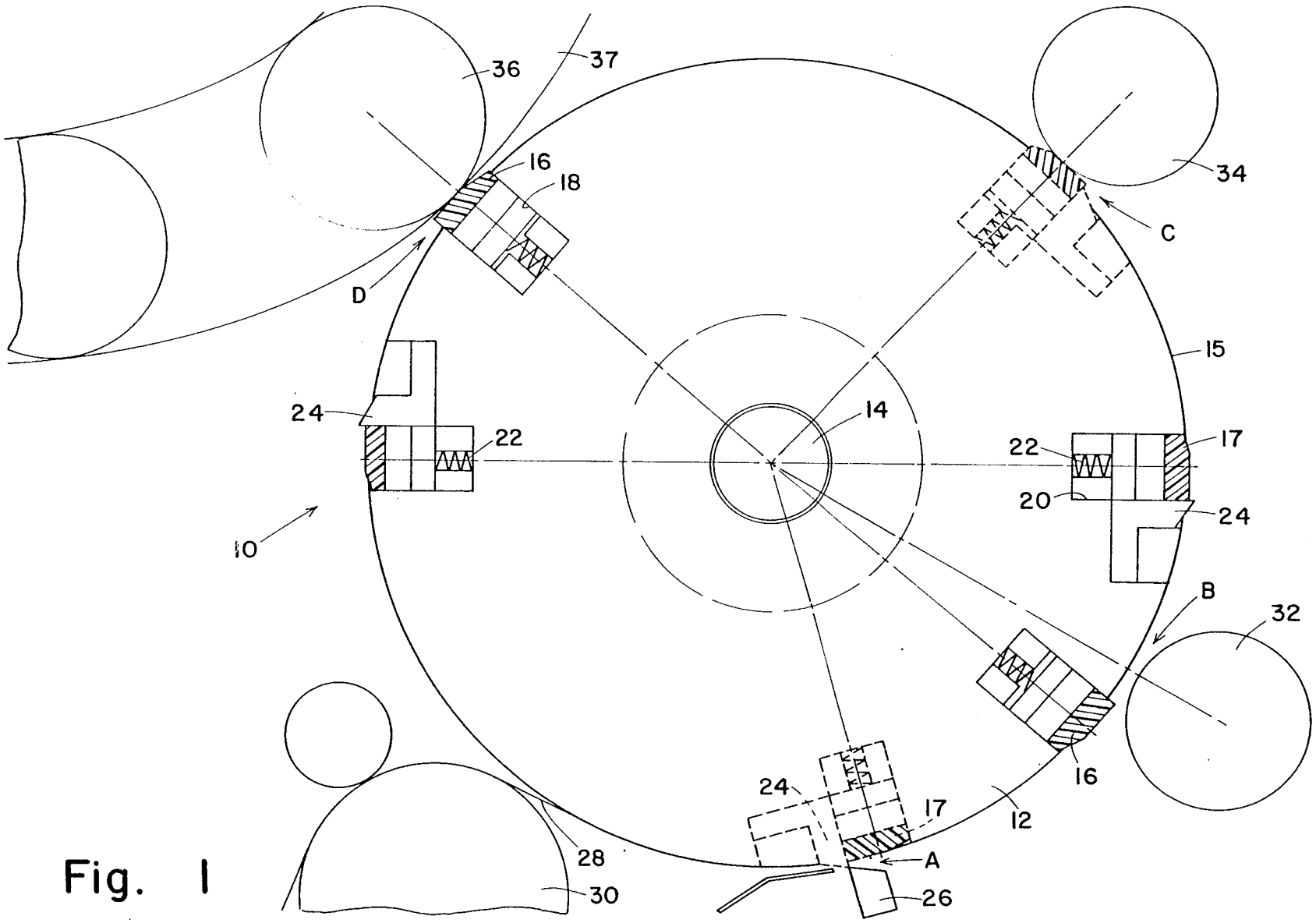
FIG. 1 is a schematic illustration of the apparatus of this invention showing the various stages of operation.

Referring now to FIG. 1 with greater particularity, the label applying apparatus 10 of this invention includes as its principal component a label transport drum 12 carried on a rotatable, driven shaft 14 and having a cylindrical label-supporting surface 15. Exposed on the cylindrical surface 15 are one or more leading edge gripping pads 16, each followed by a complementary trailing edge gripping pad 17. The gripping pads are slidably carried on the label transport drum 12 for reciprocal movement in a generally radial direction to extend them and retract them in radial slots 18 and 20. The gripping pads 16 and 17 are biased outward by springs 22 and, as will be described hereinafter, are retracted by cam means.

Mounted on the label transport drum 12 closely adjacent each of the trailing edge grippig pad 17 is a cutting knife 24 that severs a label from a continuous web as it is moved by a stationary blade component 26 at station A. As used in this application, the term "stationary", as applied to the shear blade 26, means simply that it is in fixed position at the time of severing a label. However, it may actually be moved to pivot away from the label transport drum 12 by any suitable means, such as a hydraulic cylinder, to prevent engagement of the rotating blade 24 and the stationary shear blade 26 when no label material web is being fed to the label transport drum 12.

As the web or strip 28 of labeling material is fed by a feed roller 30 from a source of supply (not shown) onto the label transport drum 12 its leading edge is gripped by a leading edge gripping pad 16, which at the time, is retracted to avoid interference with the stationary blade 26. By reason of the slightly greater rotational speed of the drum 12, the label material web 28 is placed under slight tension. Then, as the drum 12 carries the cutting blade 24 past the stationary cutter 26 at station A, the associated trailing edge gripping pad 17 is also in retracted position, as shown in phantom. Hence, the blade 24 is exposed and the pad 17 will not interfere with the cutting action of the blade.

As the leading edge of the label is moved past the first glue applying roller 32 at station B, the leading edge gripping pad 16 is extended to press the label against the glue roller 32, applying a strip of glue at the leading edge of the label. If the same type glue is to be applied to the trailing edge, the trailing edge gripping pad 17 is likewise extended as it approaches the glue roller 32 to apply a strip of glue to the trailing edge. However, there may be instances wherein a different glue is to be applied to the trailing edge. This could occur, for example, if the leading edge is to be adhered directly to a can or bottle and the trailing edge is to be adhered to the label itself, as by overlapping the leading edge. In such instance, the leading edge gripping pad 16 is retracted as it approaches the second glue roller 34 at station C, and the trailing edge gripping pad 17, which remained retracted as it passed the stationary blade 26 and the first glue roller 32, is then extended to press the trailing edge of the label against the second glue roller 34, thereby applying glue to the trailing edge of the label. It is thereafter retracted.

After glue has been applied to both the trailing and leading edges of the label, the label transport drum 12 rotates further to engage a container 36, which is carried past the drum on a suitable conveyor, such as a turret 37. In this position at station D, the leading edge gripping pad 16 is extended to press the leading edge against the container and then it releases the label to allow the label to be wrapped about the container 36.

Figure 2:
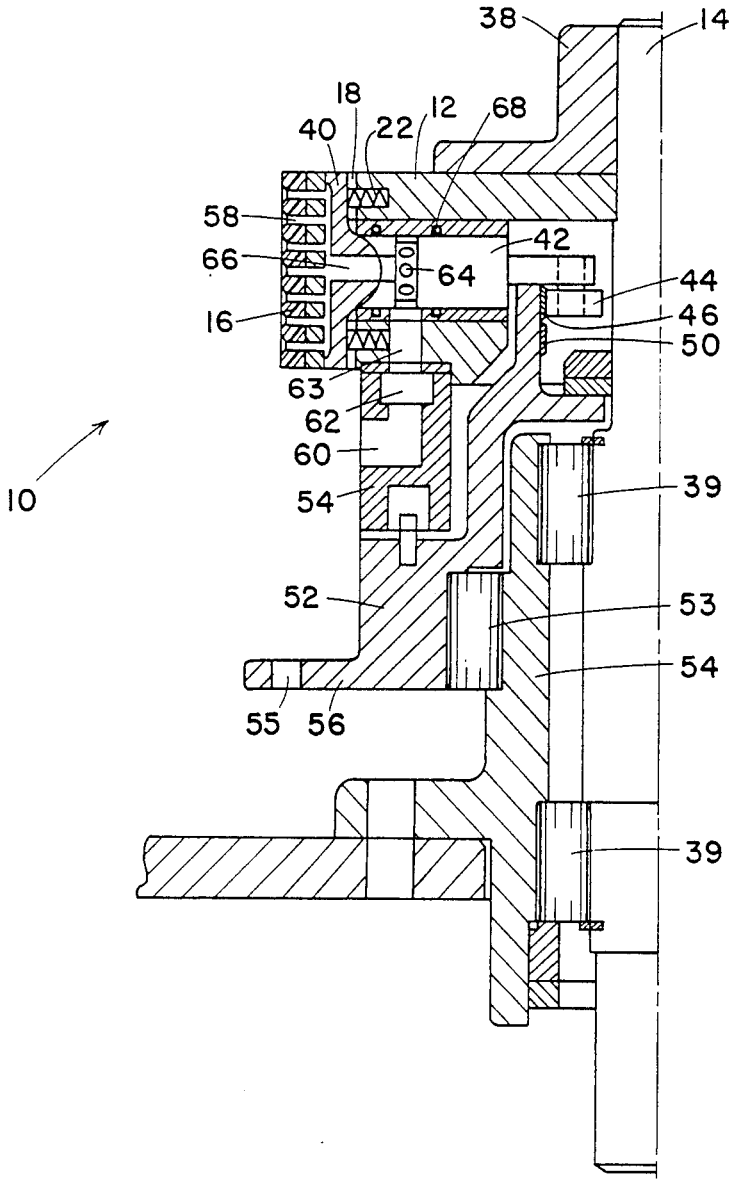
FIG. 2 is a partial section view of the tape transport drum of this invention.
Figure 3:
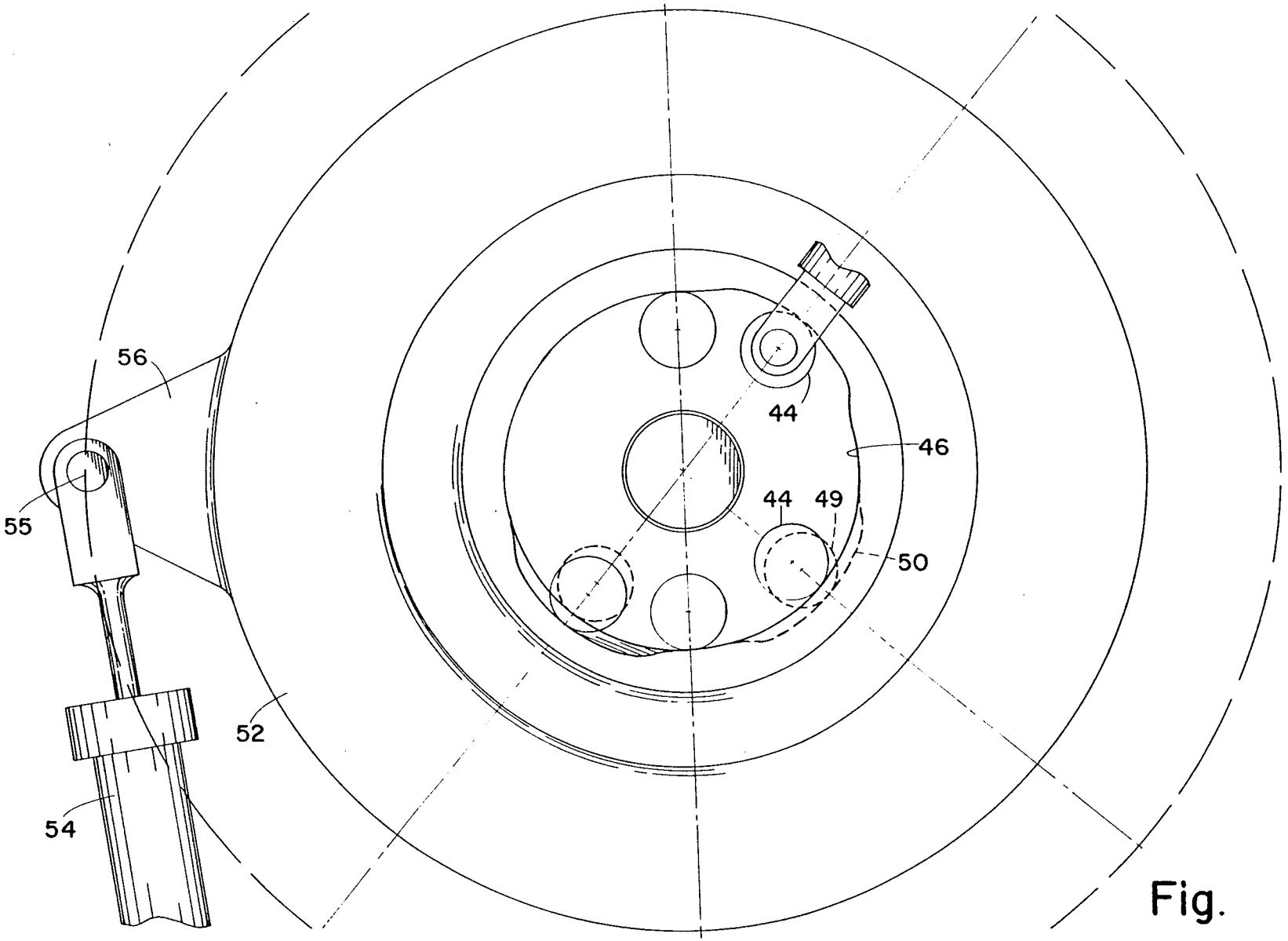
FIG. 3 is a plan view of the cam control mechanism.

Referring now to FIG. 2, the label transport drum 12 is shown mounted on the driven shaft 14 and secured by a mounting flange 38, the driven shaft 14 being rotably mounted on bearings 39. The gripping or vacuum pad 16 is carried on a rectangular guide 40 received in the rectangular recess 18 on the drum. The guide 40 in turn is carried on a guide shaft 42 on the end of which is a cam follower roller 44. The cam follower 44 rolls around a cam track 46 to retract the guide shaft 42 against the action of the springs 22 when it is desired to retract the vacuum pad 16. A second cam follower 49 (FIG. 3) rolls around another cam track 50 to direct reciprocal action of the trailing edge gripping pad 17. By having the cam retract the vacuum pads 16 and 17 and the springs 22 extend them, the pads will yield somewhat as they press the labels against the glue rollers and the containers. On the other hand, cam-retraction of the pads is positive, so that failure of a spring will not result in interference with the stationary blade 26.

The cam tracks 46 and 50 are carried on a cam housing 52, which is mounted on bearings 53 for limited rotary movement on the machine frame 54. Hence, in the event of the absence of a label, as detected by suitable means, such as a conventional photosensing device, provision may be made for avoiding contact of the vacuum pads 16 and 17 with the glue applying rollers 32 and 34. In such event, the cam housing 52 is rotated through a small arc to delay operation of the cam followers 44 and 49 until the vacuum pads 16 and 17 have moved past the glue rollers 32 and 34. The partial rotation of the cam housing 52 may be accomplished by means of a pneumatic or hydraulic cylinder 54 (FIG. 3) pivotally connected at 55 to a radial arm 56 carried on the cam housing 52.

Referring again to FIG. 2 the label gripping pads 16 (and 17 as well) may be made of an elastomeric material applied to the rectangular guide 40 to grip the label material by means of a vacuum drawing through a plurality of perforations 58 therethrough. A suitable fitting 60 on the frame 54 is connected to a source of vacuum (not shown) and opens into an arcuate slot 62 so that on rotation of the turret through the length of the slot, in conventional manner, the vacuum will be exposed through duct 63 and radial openings 64 in the guide shaft and an axial passageway 66 opening to the pad perforations 58, the guide rod 42 being sealed by suitable O-rings 68 as the guide shaft reciprocates through its short stroke. When the end of the slot 62 is reached, the duct 63 is shut off to the vacuum, and may even be exposed to an air hole (not shown) to cause the vacuum pad 16 to release the label.

In the event that the vacuum pads 16 or 17, or the knives 24, become worn, they may be replaced without replacing the drum itself 12. This represents a substantial saving over conventional machines wherein the entire label transport drum requires replacement from time to time, at considerable expense.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. Container labeling apparatus comprising:

a rotatably mounted label transport drum;

a first pad carried on said drum operative to grip the leading edge of a container label;

a second pad carried on said drum operative to grip the trailing edge of a container label;

means for continuously feeding a web of label material onto said drum with its leading edge held by said first pad;

a main label-cutting knife mounted on said drum to rotate therewith;

a complementary label cutting member mounted adjacent said drum;

said main knife extending radially from said drum immediately following said second gripping pad to sever a label as it moves past said complementary cutting member;

at least one glue applicator for applying adhesive to a label pressed against it;

means for positioning each of said label-gripping pads radially outward beyond said main label-cutting knife to press against a glue applicator, during the movement thereof past said glue applicator;

container conveyor means for moving containers; and means for transferring a label from said drum to a container on said conveyor.

2. The container labeling apparatus defined by claim 1 wherein:

each of said label gripping pads has a plurality of openings therethrough connected to an air passageway; and means connecting said air passageway to a source of vacuum during movement of a pad between said complementary label cutting member and said conveyor.

3. The container labeling apparatus defined by claim 2 including:

means for connecting said air passageway to a source of pressurized air after said vacuum source is interrupted.

4. The container labeling apparatus defined by claim 1 including:

a pair of plungers mounted in said drum for reciprocal, generally radial movement thereon;

each of said plungers carrying one of said first and second pads;

yieldable means biasing each of said plungers outward;

a cam follower carried on each of said plungers; and a cam carried on said drum and shaped to retract a plunger against action of said yieldable means to prevent engagement with said first label cutting member, and to enable said yieldable means to force said plunger outward to press a label into engagement with said glue applicator.

5. The container labeling apparatus defined by claim 4 wherein:

said cam is rotatably mounted and including:

means for rotating said cam in absence of a label to an inactive position wherein outward movement of a plunger is retarded until after it is moved past said glue applicator.

6. The container labeling apparatus defined by claim 1 wherein said container conveyor is adjacent to said drum, and said label transferring means includes:

means for positioning said first label-gripping pad radially outward during movement thereof past said conveyor to press the leading edge of a label against a container thereon.

7. Container labeling apparatus comprising:

a rotatably mounted label transport drum;

a first vacuum pad carried on said drum operative to grip the leading edge of a container label;

a second vacuum pad carried on said drum operative to grip the trailing edge of a container label;

a pair of arcuately spaced glue applicators for applying adhesive to a label pressed against it;

cam means for moving one of said vacuum pads radially outward just prior to and during the movement of said one pad past one of said glue applicators while retaining the other vacuum pad retracted, and for moving the other vacuum pad radially outward just prior to and during movement of said other pad past the other of said glue applicators while holding said one vacuum pad retracted;

container conveyor means for moving containers; and means for transferring a label from said drum to a container on said conveyor.

8. The container labeling apparatus defined by claim 7 wherein said container conveyor moves adjacent said drum and said label transferring means includes:

means for positioning said first vacuum pad radially outward during movement thereof past said conveyor to press the leading edge of a label against a container thereon.

* * * * *